United States Patent [19]

Scheiding

[11] 4,055,139

[45] Oct. 25, 1977

[54] CONVEYING AND RETAINING APPARATUS

[76] Inventor: Horst Scheiding, Duringer Str. 4, 2854 Loxstedt, Germany

[21] Appl. No.: 628,677

[22] Filed: Nov. 3, 1975

[30] Foreign Application Priority Data

Nov. 14, 1974 Germany ..... 2454099

[51] Int. Cl.[2] ..... B63B 35/00

[52] U.S. Cl. ..... 114/270; 214/12; 182/142; 51/429

[58] Field of Search ..... 114/70, 222, 73, .5 R, 114/270; 214/12, 14, 15 R, 15 C; 187/6, 8, 80, 92; 248/206 R, 206 A; 51/9 R, 9 M; 335/296; 182/142; 290/55, 52

[56] References Cited

U.S. PATENT DOCUMENTS

| | | | |
|---|---|---|---|
| 2,543,348 | 2/1951 | Briese | 114/222 |
| 2,841,246 | 7/1958 | Lamb | 214/15 R |
| 3,375,900 | 4/1968 | Conley | 182/142 |
| 3,609,612 | 9/1971 | Tibbling | 114/222 |
| 3,638,600 | 2/1972 | Modrey | 114/222 |
| 3,776,279 | 12/1973 | O'Connor, Jr. | 290/55 |

FOREIGN PATENT DOCUMENTS

| | | | |
|---|---|---|---|
| 2,053,563 | 5/1972 | Germany | 114/.5 R |

*Primary Examiner*—Trygve M. Blix
*Assistant Examiner*—Jesus D. Sotelo
*Attorney, Agent, or Firm*—Sughrue, Rothwell, Mion, Zinn and Macpeak

[57] ABSTRACT

An apparatus for transporting and retaining payloads on ferrous metal surfaces, using at least one electromagnet, obviating the need for electric wiring from a ship by utilizing an electricity supply facility which is disposed on the apparatus, such supply facility preferably being a compressed-air motor and D.C. generator.

8 Claims, 4 Drawing Figures

CONVEYING AND RETAINING APPARATUS

Figure 1:
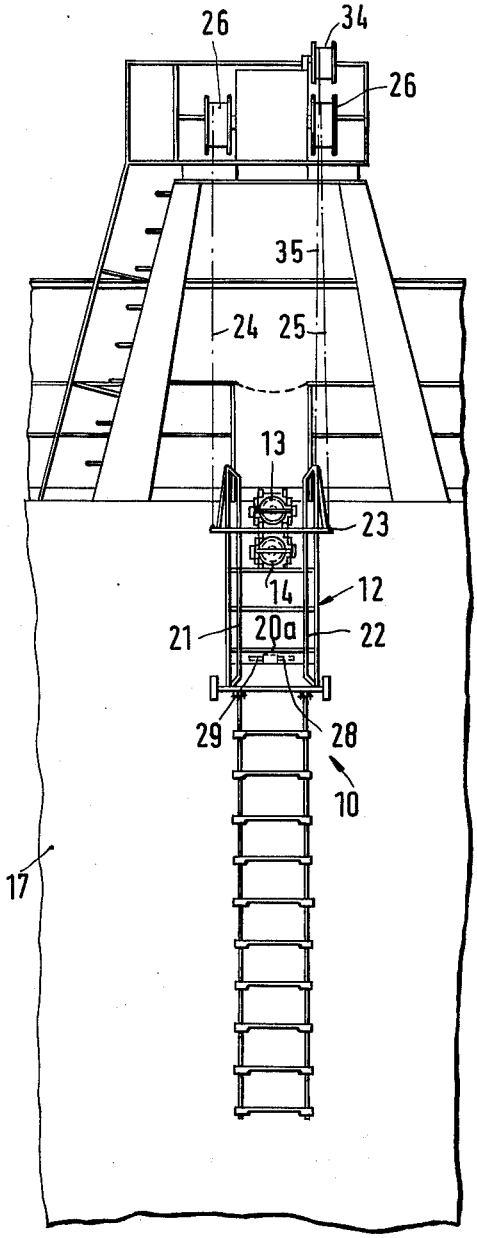

This invention relates to an apparatus for transporting and retaining payloads on ferrous metal surfaces, more particularly the outboard walls of ships, the apparatus having at least one electromagnet located at a reduced distance from the moved-over surface by running gear on a bearing frame adapted to receive the payloads. The invention relates more particularly, but not exclusively, to a pilot lift secured to the outboard wall of a ship by electromagnets.

Apparatus of the kind described, inter alia as a pilot lift, are disclosed in German patent specification No. 20 53 563. A shipboard electric-motor-driven winch acts by way of hoisting or lifting cables to move — that is raise and/or lower — a bearing frame and running gear thereon along a ship's outboard wall. Electromagnets secured to the running frame are powered from the shipboard electricity supply system via wiring extending from on board the ship to the pilot lift or the like.

An electrically powered transport or conveying apparatus of the kind described is satisfactory or advantageous for many uses, such as for ships carrying cargoes not likely to explode, such as container freighters, bulk freighters and so on. There are objections to the use of the known conveying and retaining facilities, more particularly as pilot lifts, in ships where there is a likelihood of explosions, more particularly tankers, even though all the electrical installation is of top fireproof grade. The main risk comes from the electric cable running exposed from the ship's deck to the lift. Accidental mechanical damage to the cable, for example because of events during loading, might have serious effects on board a tanker.

The difficulties referred to appear to be in technical contradiction with the need for the running-gear electromagnets to be supplied with electric power.

It is, therefore, an object of the present invention to provide a transport or retaining apparatus, more particularly a pilot lift, which has electromagnets and which is free from the risks of electrical engineering installations for uses where there is a risk of explosion.

According to the present invention there is provided an apparatus suitable for transporting and retaining payloads on ferrous metal surfaces, more particularly the outboard walls of ships, which apparatus comprises at least one electromagnet, means for locating the eletromagnet at a reduced distance from a surface to be moved over, the locating means comprising running gear on a bearing frame adapted to receive the payloads and an electricity supply facility for serving the electromagnet being disposed on the running gear or support frame.

Thus, the apparatus according to the invention is distinguished by an electricity supply facility which serves the or each electromagnet and which is disposed on the running gear or support frame. According to the preferred feature of the invention, the current supply facility takes the form of a D.C. generator disposed on the running gear or bearing frame, such generator producing the electric power required to operate the magnets and being driven by a flow motor, more particularly a compressed-air motor. The resulting unit embodied by such motor and such generator is received as an enclosed device preferably in a casing-like rung of the bearing frame which has, in the case of pilot lifts, a number of fixed rungs.

The apparatus according to the invention obviates the need for electric wiring from the ship or its deck to the apparatus. Since the motor used to drive the D.C. generator is preferably an air motor, all that is needed is a compressed-air line extending from a stationary deck-mounted air compressor to the compressed-air motor of the conveying apparatus. The compressed air line is not an explosion risk.

Also, the electrical wiring between the D.C. generator and the electromagnets is a fixed item and satisfactorily enclosed, more particularly in appropriately devised parts of the bearing-frame structure.

Figure 2:
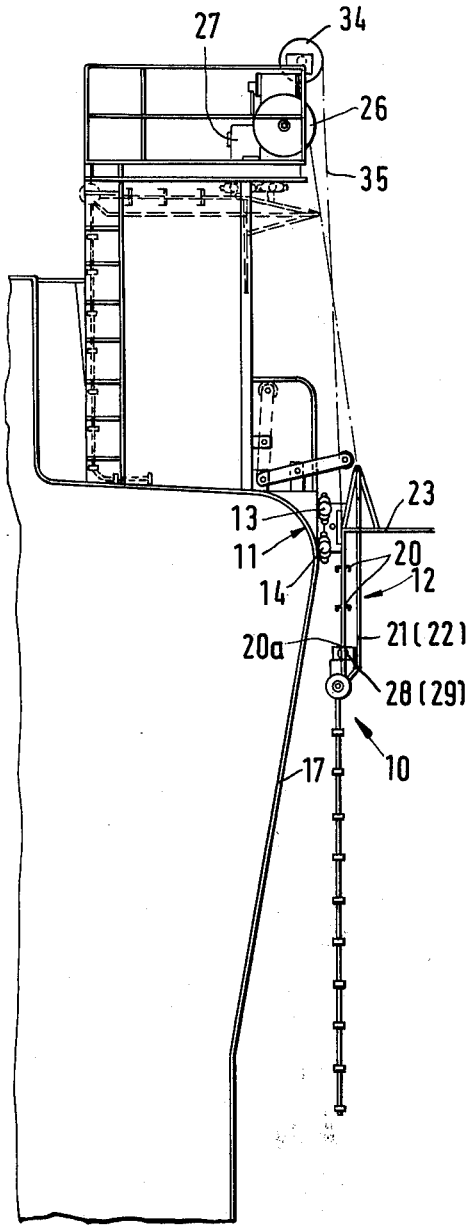
Figure 3:
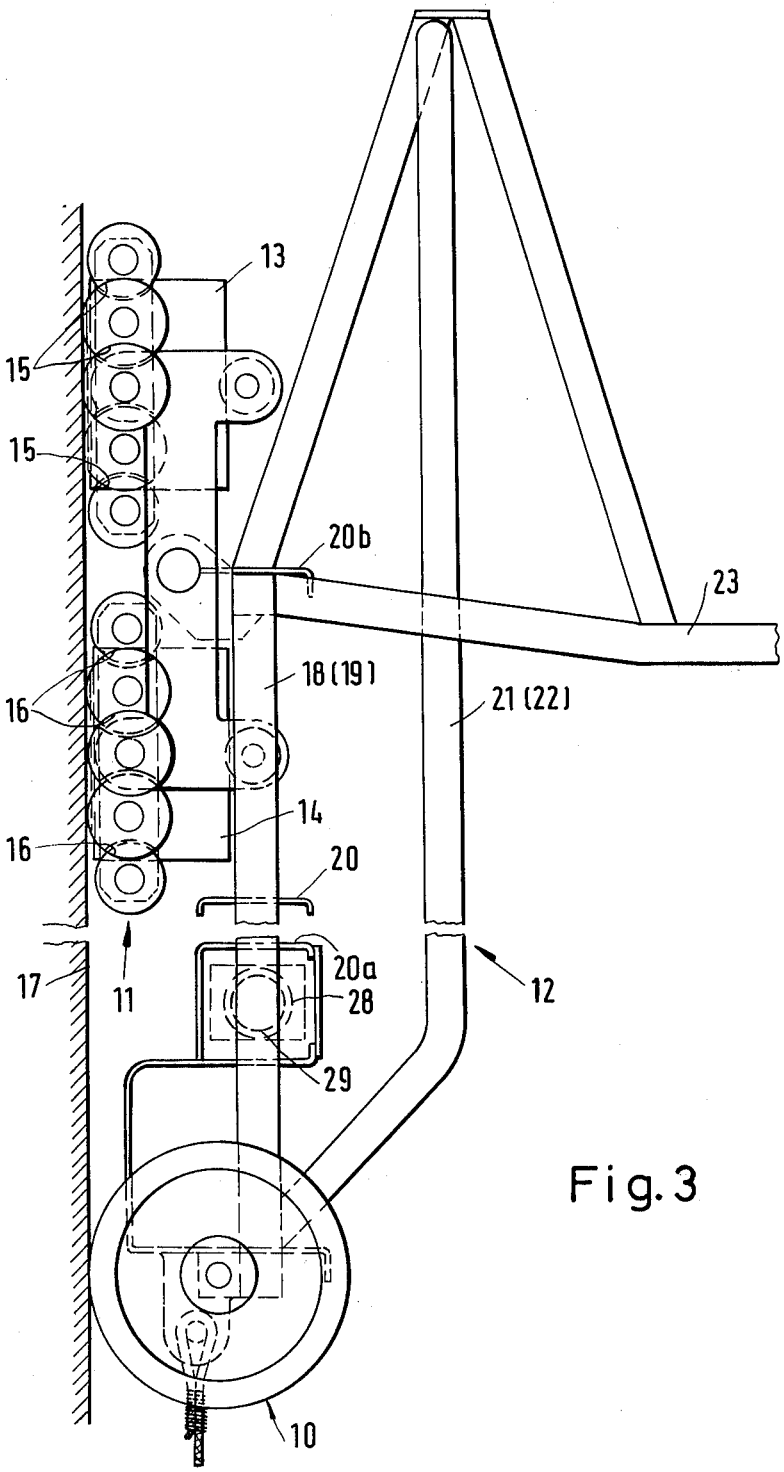
Figure 4:
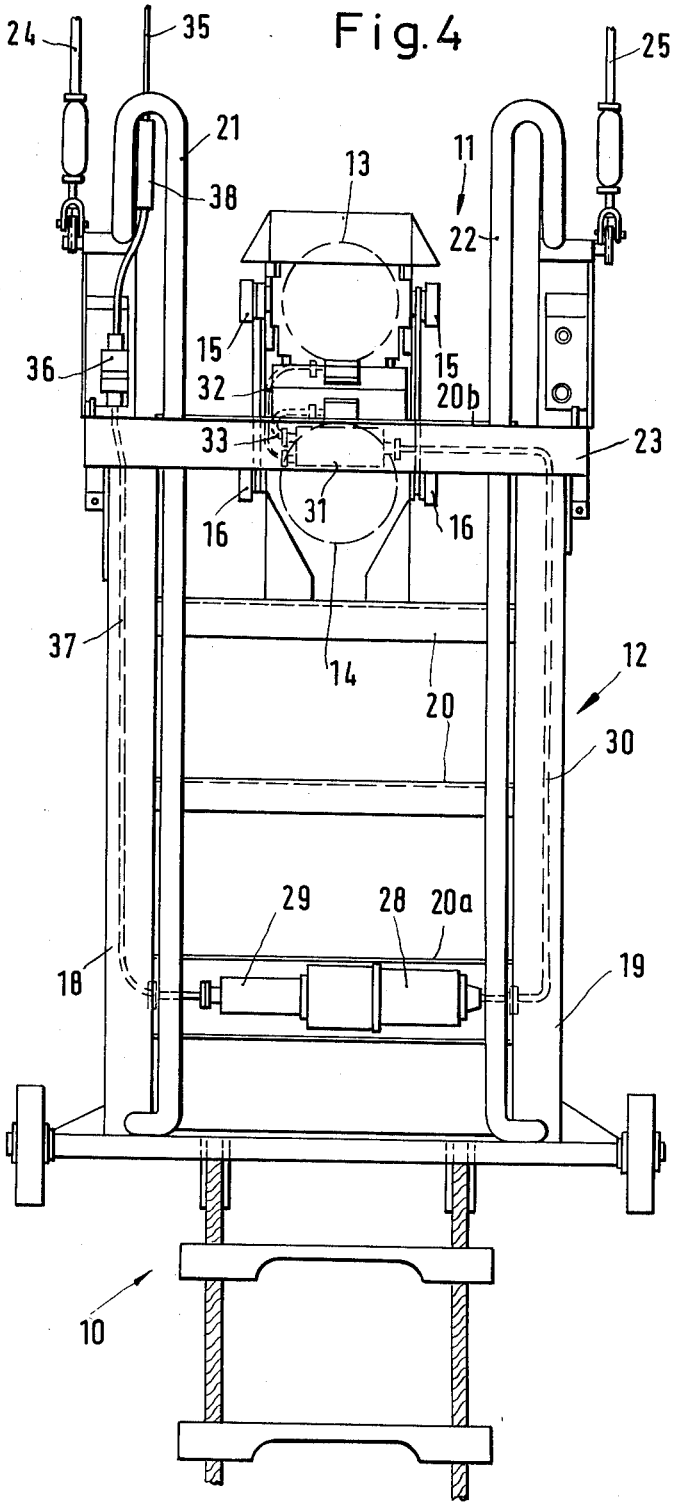

For a better understanding of the present invention and to show how the same may be carried into effect, reference will now be made, by way of example, to the accompanying drawings, in which:

FIG. 1 shows a view looking on to an outboard wall of the ship of a conveying and retaining apparatus devised as a pilot lift, together with a part of the construction of the ship, FIG. 2 shows a side view corresponding to FIG. 1, FIG. 3 shows a side elevational view of the top part of a pilot lift apparatus, to an enlarged scale, and FIG. 4 shows a plan view of the apparatus shown in FIG. 3.

Referring now to the drawings, which show the preferred use of the invention, viz. in a conveying apparatus for pilots or a pilot lift 10. In the present case, the same is embodied by running gear 11 and, disposed thereon, a bearing frame 12. The running gear 11 has two electromagnets 13 and 14. A large number of specially arranged running rollers 15 and 16 are provided to ensure that the electromagnets are always positioned at a particular very reduced distance from the running surface which in the present case is outboard wall 17 of a ship.

In the present case, the frame 12 comprises inter alia two upright hollow section struts 18 and 19 and, extending therebetween, fixed rungs 20, **20*a* 20*b*. Tubular holding rails 21 and 22 are provided at a distance from the struts 18 and 19 and rungs 20, 20*a* and 20*b*. Also, there is a closed stirrup-shaped member 23** at the top.

The resulting pilot lift can, because of the rollers 15 and 16, move vertically on the wall 17. To this end, two lifting or hoisting cables 24 and 25 are connected to the top of the apparatus — that is to the frame 12. The cables 24 and 25 extend to a deck-mounted drum 26 of a winch driven preferably by a compressed-air motor 27.

The electromagnets 13 and 14 receive their power from a unit disposed on the apparatus, viz. on the frame 12. The current supply unit comprises in the present case a D.C. generator 28, and, directly connected thereto, a compressed air motor 29. The generator 28 is dimensioned to provide an output corresponding to the power consumption of the electromagnets 13 and 14. To prevent sparking, a voltage of less than 25 volts is used and is satisfactory. The pilot lift 10 is therefore secured to the outboard wall 17 of the ship by means of electromagnets 13 and 14.

The generator 28 and motor 29 are received in a casing-like rung **20*a* of the frame 12 and are, therefore, completely enclosed. Electric wiring 30 extends out of the casing (rung 20*a*) to a distribution box 31 which is also received near a casing-like rung 20*b*. Further wiring 32 and 33 extends from the box 31 to the two electromagnets 13 and 14. All the wiring 30, 32 and 33 is a fixed installation and is either mainly or entirely (wiring 30) enclosed by being disposed in parts of the construction of the frame 12. Wiring 30 extends from rung 20***a* into the lateral strut 19 and therefrom into the rung 20*b* and to the distribution box.

The motor 29 is powered by a stationary deck-mounted air compressor which is connected to a drum 34 receiving a flexible air line or hose 35 extending to the lift 10. As the lift 10 moves, the flexible line or hose 35 unwinds from or winds onto the drum 34.

The hose 35 is connected byway of a hose connector or coupling 36 to a fixed air line 37 of the running gear 11. In the present case, the line 37, like the electric wiring 30, is disposed in the lateral strut 18, extends into the casing-like rung 20*a* and is connected to the compressed air motor 29. For safety reasons, the hose 37 is fitted near the lift with a known kind of device 38 for reducing pull on the hose.

The normal range of movement of the lift 10 is limited at the top by the top edge of the wall 17. However, and as the chain lines in FIG. 2 indicate, the lift 10 can all be pulled in below a bridge structure on the deck. To ensure that no electricity flows in this region, when the lift 10 passes beyond the top edge of the wall, automatic means operate to stop the supply of air to the motor 27, so that the generator 28 ceases to generate.

Although the lift 10 moves with its power supply unit "on" exclusively outside that area of a ship which is statutorily held to be at risk from explosion, according to another feature of the invention additional steps can be taken to explosion-proof the power supply unit. To this end, a positive pressure is produced in the casing — embodied here by the rung 20*a* — during operation, to impede the access of external air which increases the explosion risk. The motor 29 can be used very simply to produce the positive pressure in the casing-like rung 20*a* by the air discharge from such motor going not directly to atmosphere from the motor but discharging into the casing-like rung 20*a.* The same is so devised, with joints and fissures and, if necessary, further venting orifices, that the air discharged by the motor 29 can escape to the outside atmosphere but only by building up the pressure in the casing. The compressed air for the motor 29 is supplied from a region where air, which is neutral so far as the risk of explosion is concerned, is available.

What is claimed is:

1. In an apparatus suitable for transporting and retaining payloads on ferrous metal surfaces using electromagnetic holding devices, more particularly a pilot lift on the outboard walls of ships having at least one electromagnet disposed at a reduced distance from a surface to be moved over by running gear on a bearing frame adapted to receive the payloads, the improvement comprising an electricity generating unit for providing power to the electromagnet being mounted on said bearing frame, said generating unit comprising a D.C. generator drivable by a compressed-air motor, said generator capable of producing electric power for the electromagnet, and being disposed on the bearing frame.

2. The apparatus of claim 1, in which the compressed-air motor is driveable, by way of an air line utilizing a remote and fixedly installed compressed-air unit disposed on the deck of a ship.

3. The apparatus of claim 2, wherein as the compressed-air line is disposed fixedly in components of the bearing frame extending from the compressed-air motor.

4. The apparatus of claim 1, wherein said pilot lift has fixed rungs, one rung being a casing for the compressed-air motor and the D.C. generator.

5. The apparatus of claim 4, further including means whereby the air discharged by the compressed-air motor is adapted to be conveyed into the casing for the compressed-air motor and the D.C. generator and can be discharged from said casing, producing an increased internal pressure therein.

6. The apparatus of claim 1, in which electric lines between the D.C. generator and the electromagnets are arranged in a fixed and enclosed manner in a vertical strut of the bearing frame.

7. The apparatus of claim 1, wherein a compressed-air hose is disposed in windable relationship with a stationary drum disposed on the ship's deck.

8. The apparatus of claim 1, including means whereby, when the critical limit of the path of movement of the apparatus is passed, more particularly when the top board edge of a ship is passed, the D.C. generator can be stopped by interruption of the compressed-air.

* * * * *